US011557240B2

(12) United States Patent
Kim

(10) Patent No.: US 11,557,240 B2
(45) Date of Patent: Jan. 17, 2023

(54) DRIVING CONTROLLER, DISPLAY APPARATUS HAVING THE SAME AND METHOD OF DRIVING THE SAME

(71) Applicant: Samsung Display Co., Ltd., Yongin-Si (KR)

(72) Inventor: Sang Kuk Kim, Seoul (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/583,924

(22) Filed: Jan. 25, 2022

(65) Prior Publication Data

US 2022/0319373 A1 Oct. 6, 2022

(30) Foreign Application Priority Data

Apr. 6, 2021 (KR) ..... 10-2021-0044874

(51) Int. Cl.
*G09G 3/20* (2006.01)

(52) U.S. Cl.
CPC ..... *G09G 3/20* (2013.01); *G09G 2310/08* (2013.01); *G09G 2330/06* (2013.01); *G09G 2340/0435* (2013.01)

(58) Field of Classification Search
None
See application file for complete search history.

(56) References Cited

U.S. PATENT DOCUMENTS 7,142,187 B1 * 11/2006 Kim ..... G09G 5/18 345/87
7,161,970 B2 1/2007 Lim et al.
7,679,457 B2 * 3/2010 Satoh ..... H03B 28/00 331/49
9,571,880 B2 * 2/2017 Chuang ..... H04N 21/4305
10,096,302 B2 * 10/2018 Roh ..... G09G 5/18
2004/0041599 A1 * 3/2004 Murphy ..... H03B 28/00 327/129
2013/0286302 A1 * 10/2013 Fujioka ..... G02F 1/13338 349/12

FOREIGN PATENT DOCUMENTS

KR 10-2110390 B1 6/2020

* cited by examiner

*Primary Examiner* — Dorothy Harris
(74) *Attorney, Agent, or Firm* — Innovation Counsel LLP

(57) ABSTRACT

A driving controller includes an oscillator and a signal generator. The oscillator is configured to generate an oscillation signal based on an input current. The signal generator is configured to generate a gate driving signal and a data driving signal based on the oscillation signal. The oscillator is configured to maintain a frequency of one horizontal period of the oscillation signal to be constant when an oscillation fundamental frequency is shifted. When the oscillation fundamental frequency is f0 and a fundamental constant is N0, the frequency of one horizontal period is f0/N0.

20 Claims, 5 Drawing Sheets

DRIVING CONTROLLER, DISPLAY APPARATUS HAVING THE SAME AND METHOD OF DRIVING THE SAME

PRIORITY STATEMENT

This application claims priority under 35 U.S.C. § 119 to Korean Patent Application No. 10-2021-0044874, filed on Apr. 6, 2021 in the Korean Intellectual Property Office KIPO, the contents of which are herein incorporated by reference in their entireties.

BACKGROUND

1. Field

Embodiments of the present disclosure relate to a driving controller and a display apparatus including the driving controller and a method of driving the display apparatus. More particularly, embodiments of the present disclosure relate to a driving controller reducing an electromagnetic interference ("EMI") and enhancing a display quality of a display panel and a display apparatus including the driving controller and a method of driving the display apparatus.

2. Description of the Related Art

Generally, a display apparatus includes a display panel and a display panel driver. The display panel includes a plurality of gate lines and a plurality of data lines. The display panel driver includes a gate driver, a data driver and a driving controller. The gate driver outputs gate signals to the gate lines. The data driver outputs data voltages to the data lines. The driving controller controls the gate driver and the data driver.

A clock signal used in the display panel driver may be generated by an oscillator in the driving controller. A fundamental frequency of the oscillation signal of the oscillator or harmonic components of the fundamental frequency may overlap a communication band of the display apparatus so that an EMI may be generated and a communication quality may be deteriorated.

To prevent a generation of the EMI, the fundamental frequency of the oscillation signal may be shifted. When the fundamental frequency of the oscillation signal is shifted to prevent the generation of the EMI, a frequency of a driving signal used in the driving controller, the gate driver and the data driver may be shifted according to the shift of the fundamental frequency of the oscillation signal. Thus, a display quality of the display panel may be deteriorated.

SUMMARY

Embodiments of the present disclosure provide a driving controller having a constant frequency of one horizontal period to reduce an electromagnetic interference ("EMI") and not to affect a display quality of a display panel in spite of a shift of an oscillation fundamental frequency.

Embodiments of the present disclosure provide a display apparatus including the driving controller.

Embodiments of the present disclosure also provide a method of driving the display apparatus.

In an embodiment of a driving controller according to the present disclosure, the driving controller includes an oscillator and a signal generator. The oscillator is configured to generate an oscillation signal based on an input current. The signal generator is configured to generate a gate driving signal and a data driving signal based on the oscillation signal. The oscillator is configured to maintain a frequency of one horizontal period of the oscillation signal to be constant when an oscillation fundamental frequency is shifted.

In an embodiment, when the oscillation fundamental frequency is f0 and a fundamental constant is N0, the frequency of one horizontal period may be f0/N0.

In an embodiment, when a first oscillation shifted frequency which is shifted from the oscillation fundamental frequency by Δf is f1 and a first shift constant is N1, f1/N1 may be substantially equal to f0/N0.

In an embodiment, f1=f0+Δf, N1=N0+ΔN, $$\Delta f = \Delta N \frac{f0}{N0} \text{ and}$$

$$\frac{f1}{N1} = \frac{f0 + \frac{f0}{N0}\Delta N}{N0 + \Delta N} = \frac{f0}{N0}.$$

ΔN may mean a first number of a unit of the frequency of one horizontal period which is shifted from the oscillation fundamental frequency.

In an embodiment, when a second oscillation shifted frequency which is shifted from the first oscillation shifted frequency by Δf' is f2 and a second shift constant is N2, f2/N2 may be substantially equal to f1/N1 and f0/N0.

In an embodiment, f2=f1+Δf', N2=N1+ΔN', $$\Delta f' = \Delta N' \frac{f1}{N1} \text{ and}$$

$$\frac{f2}{N2} = \frac{f1 + \frac{f1}{N1}\Delta N'}{N1 + \Delta N'} = \frac{f1}{N1} = \frac{f0}{N0}.$$

ΔN' may mean a second number of the unit of the frequency of one horizontal period which is shifted from the first oscillation shifted frequency.

In an embodiment, the driving controller may further include a current setter configured to provide the input current to the oscillator. The current setter may be configured to output a first input current, which causes the oscillator to output a first oscillation signal having the oscillation fundamental frequency, to the oscillator. The current setter may be configured to output a second input current, which causes the oscillator to output a second oscillation signal having the first oscillation shifted frequency, to the oscillator.

In an embodiment, the driving controller may further include a comparator configured to receive the oscillation signal outputted from the oscillator and to generate a comparison signal configured to control the current setter.

In an embodiment, the comparator may include a first input terminal configured to receive the oscillation signal, a second input terminal configured to receive an external clock signal and an output terminal configured to output the comparison signal representing a result of comparison between the first input terminal and the second input terminal.

In an embodiment, the external clock signal may be a clock signal of a communication interface for communication between the driving controller and an external host.

In an embodiment, a frequency of the external clock signal may be greater than the oscillation fundamental frequency.

In an embodiment of a display apparatus according to the present disclosure, the display apparatus includes a display panel, a gate driver, a data driver and a driving controller. The gate driver is configured to output a gate signal to a gate line of the display panel. The data driver is configured to output a data voltage to a data line of the display panel. The driving controller is configured to control the gate driver and the data driver. The driving controller may include an oscillator configured to generate an oscillation signal based on an input current and a signal generator configured to generate a gate driving signal and a data driving signal based on the oscillation signal. The oscillator is configured to maintain a frequency of one horizontal period of the oscillation signal to be constant when an oscillation fundamental frequency is shifted.

In an embodiment, a frequency of the gate driving signal may be synchronized with a frequency of the oscillation signal. A frequency of the gate signal may be synchronized with the frequency of the oscillation signal.

In an embodiment, a frequency of the data driving signal may be synchronized with a frequency of the oscillation signal.

In an embodiment, when the oscillation fundamental frequency is f0 and a fundamental constant is N0, the frequency of one horizontal period may be f0/N0.

In an embodiment, when a first oscillation shifted frequency which is shifted from the oscillation fundamental frequency by Δf is f1 and a first shift constant is N1, f1/N1 may be substantially equal to f0/N0.

In an embodiment, f1=f0+Δf, N1=N0+ΔN, $$\Delta f = \Delta N \frac{f0}{N0} \text{ and}$$

$$\frac{f1}{N1} = \frac{f0 + \frac{f0}{N0}\Delta N}{N0 + \Delta N} = \frac{f0}{N0}.$$

ΔN may mean a first number of a unit of the frequency of one horizontal period which is shifted from the oscillation fundamental frequency.

In an embodiment, when a second oscillation shifted frequency which is shifted from the first oscillation shifted frequency by Δf' is f2 and a second shift constant is N2, f2/N2 may be substantially equal to f1/N1 and f0/N0.

In an embodiment of a method of driving a display apparatus according to the present disclosure, the method includes generating a frequency of one horizontal period using an oscillation fundamental frequency and a fundamental constant, generating an oscillation signal by maintaining the frequency of one horizontal period to be constant when an oscillation fundamental frequency is shifted, generating a gate driving signal and a data driving signal based on the oscillation signal, outputting a gate signal to a display panel based on the gate driving signal and outputting a data voltage to the display panel based on the data driving signal.

In an embodiment, when the oscillation fundamental frequency is f0 and the fundamental constant is N0, the frequency of one horizontal period may be f0/N0.

According to the driving controller, the display apparatus including the driving controller and the method of driving the display apparatus, the frequency of the one horizontal period may be kept constant even when the oscillation fundamental frequency of the oscillation signal is shifted. When the oscillation fundamental frequency or harmonic components of the oscillation fundamental frequency overlap a communication band, the oscillation fundamental frequency may be shifted such that the oscillation fundamental frequency or the harmonic components of the oscillation fundamental frequency do not overlap the communication band. Thus, the EMI of the display apparatus may be reduced.

In addition, in spite of the shift of the oscillation fundamental frequency, the frequency of the one horizontal period may not be changed so that the display quality may not be deteriorated due to the shift of the oscillation fundamental frequency.

BRIEF DESCRIPTION OF THE DRAWINGS

The above and other features and advantages of the present disclosure will become more apparent by describing in detailed embodiments thereof with reference to the accompanying drawings, in which.

DETAILED DESCRIPTION OF THE EMBODIMENT(S)

Hereinafter, the present disclosure will be explained in detail with reference to the accompanying drawings.

Figure 1:
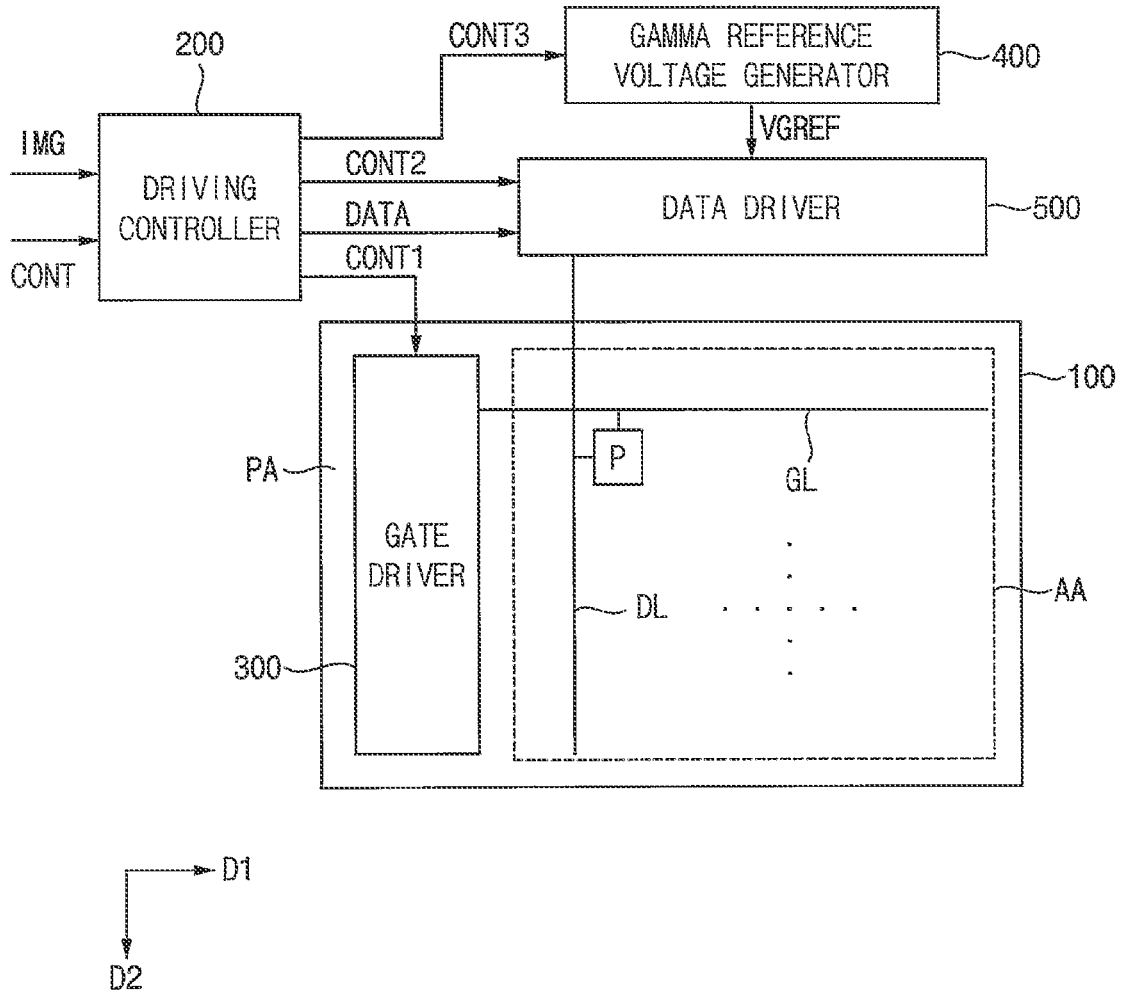
FIG. 1 is a block diagram illustrating a display apparatus according to an embodiment of the present disclosure.

FIG. 1 is a block diagram illustrating a display apparatus according to an embodiment of the present disclosure.

Referring to FIG. 1, the display apparatus includes a display panel 100 and a display panel driver. The display panel driver includes a driving controller 200, a gate driver 300, a gamma reference voltage generator 400 and a data driver 500.

For example, the driving controller 200 and the data driver 500 may be integrally formed. For example, the driving controller 200, the gamma reference voltage generator 400 and the data driver 500 may be integrally formed. A driving module including at least the driving controller 200 and the data driver 500 which are integrally formed may be called to a timing controller embedded data driver (TED).

The display panel 100 has a display region AA on which an image is displayed and a peripheral region PA adjacent to the display region AA. That is, generally, the peripheral region PA encloses the display region AA.

The display panel 100 includes a plurality of gate lines GL, a plurality of data lines DL and a plurality of pixels P connected to the gate lines GL and the data lines DL. The gate lines GL extend in a first direction D1, and the data lines DL extend in a second direction D2 crossing the first direction D1. However, this is an example, in another embodiment, the gate lines GL may extend in the second direction D2, and the datalines DL may extend in the first direction D1.

The driving controller 200 receives input image data IMG and an input control signal CONT from an external source or external sources. The input image data IMG may include red image data, green image, data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL. For example, the gate driver 300 may be integrated on the peripheral region PA of the display panel 100. For example, the gate driver 300 may be mounted on the peripheral region PA of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500. For example, the gamma reference voltage generator 400 and the driving controller 200 may be integrally formed, or the voltage generator 400 and the data driver 500 may be integrally formed as well.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL. For example, the data driver 500 may be integrated on the peripheral region PA of the display panel 100. For example, the data driver 500 may be mounted on the peripheral region PA of the display panel 100.

Figure 2:
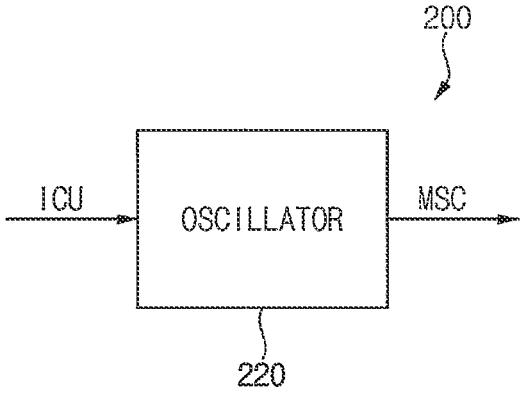
FIG. 2 is a block diagram illustrating a driving controller of FIG. 1 according to an embodiment of the present disclosure.

FIG. 2 is a block diagram illustrating the driving controller 200 of FIG. 1 according to an embodiment of the present disclosure.

Referring to FIGS. 1 and 2, the driving controller 200 may include an oscillator 220 which is disposed inside of the driving controller 200 to generate an oscillation signal MSC based on an input current ICU which is the input image data IMG. For example, when the input current ICU increases, a frequency of the oscillation signal MSC may increase. For example, when the input current ICU decreases, the frequency of the oscillation signal MSC may decrease.

Figure 3:
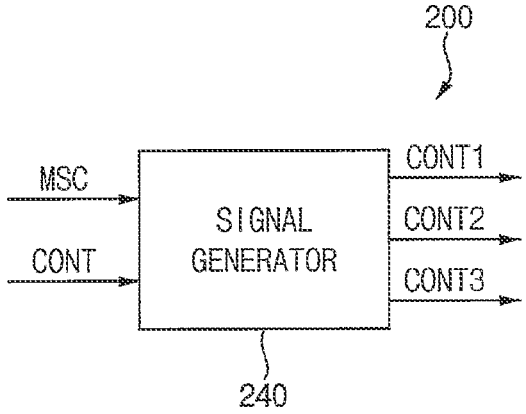
FIG. 3 is a block diagram illustrating the driving controller of FIG. 1 according to an embodiment of the present disclosure.

FIG. 3 is a block diagram illustrating the driving controller 200 of FIG. 1 according to an embodiment of the present disclosure.

Referring to FIGS. 1, 2, and 3, the driving controller 200 may further include a signal generator 240 which is connected the oscillator 220 to generate a gate driving signal and a data driving signal based on the oscillation signal MSC.

For example, the signal generator 240 may generate a main clock signal. A frequency of the main clock signal may be obtained by dividing a frequency of the oscillation signal MSC by a predetermined constant (e.g. N0). The signal generator 240 may generate the gate driving signal and the data driving signal using the main clock signal. The first control signal CONT1 may include the gate driving signal. The second control signal CONT2 may include the data driving signal.

A frequency of the gate driving signal may be synchronized with the frequency of the oscillation signal MSC and a frequency of the gate signal may be synchronized with the frequency of the oscillation signal MSC. For example, the frequency of the gate driving signal may be synchronized with a frequency of one horizontal period of the oscillation signal MSC and the frequency of the gate signal may be synchronized with the frequency of one horizontal period of the oscillation signal MSC. Herein, the gate driving signal may be a gate clock signal used to generate the gate signal.

A frequency of the data driving signal may be synchronized with the frequency of the oscillation signal MSC. For example, the frequency of the data driving signal may be synchronized with a frequency of one horizontal period of the oscillation signal MSC. Herein, the data driving signal may be the load signal defining a timing of outputting the data voltage to the display panel 100.

Figure 4:
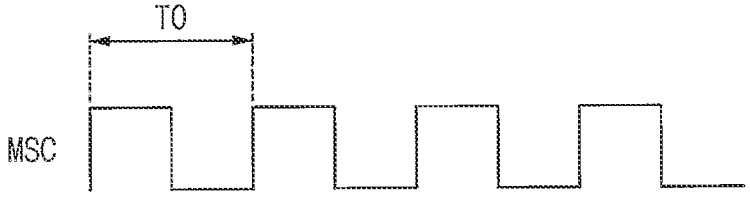
FIG. 4 is a timing diagram illustrating a waveform of an oscillation signal outputted from an oscillator of FIG. 2.
Figure 5:
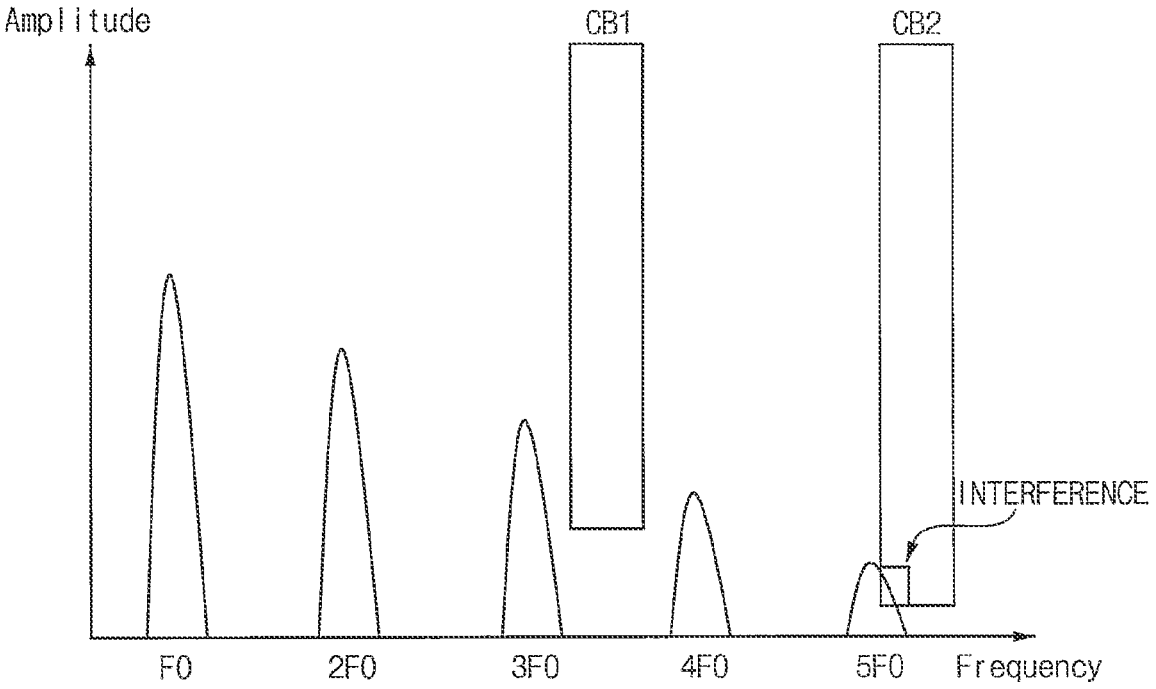
FIG. 5 is a graph illustrating a fundamental frequency of the oscillation signal of FIG. 4 and harmonic components of the fundamental frequency.

FIG. 4 is a timing diagram illustrating a waveform of the oscillation signal MSC outputted from the oscillator 220 of FIG. 2. FIG. 5 is a graph illustrating a fundamental frequency F0 of the oscillation signal MSC of FIG. 4 and harmonic components 2F0, 3F0, 4F0 and 5F0 of the fundamental frequency F0.

Referring to FIGS. 1, 2, 3, 4, and 5, the oscillation signal MSC outputted from the oscillator 220 may have a square wave or a waveform close to the square wave.

As shown in FIG. 4, a cycle of the oscillation signal MSC may be T0. Herein, the fundamental frequency corresponding to the cycle T0 of the oscillation signal MSC outputted from the oscillator 220 may be F0.

When the oscillation signal MSC has the square wave or the waveform close to the square wave, the fundamental frequency of the oscillation signal MSC is F0 and the cycle T0 of the oscillation signal MSC may have harmonic components which are multiples of the fundamental frequency F0.

When an oscillation fundamental frequency F0, which is the fundamental frequency of the oscillation signal MSC, or harmonic components 2F0, 3F0, 4F0 and 5F0 overlap a communication band CB1 and CB2, an electromagnetic interference ("EMI") may be generated by the display apparatus. A normal signal used for driving the display panel 100 may be a noise (the EMI) when operating the communication function.

In FIG. 5, 5F0, which is one of the harmonic components of the oscillation fundamental frequency F0 of the oscillation signal MSC, overlaps a second communication band CB2 so that the interference may be generated. To prevent such the interference, the oscillation fundament frequency F0 of the oscillation signal MSC may be shifted.

Figure 6:
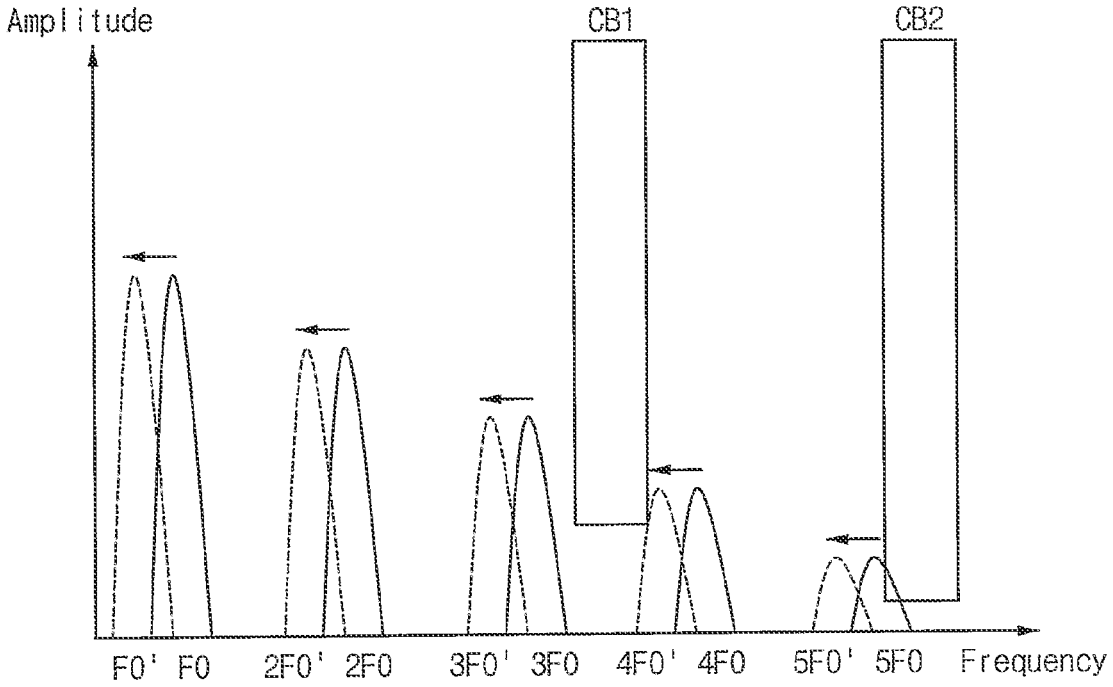
FIG. 6 is a graph illustrating a shifted frequency of the oscillation signal and harmonic components of the shifted frequency when the fundamental frequency of the oscillation signal of FIG. 4 is shifted to the shifted frequency.

FIG. 6 is a graph illustrating a shifted frequency F0' of the oscillation signal MSC and harmonic components 2F0', 3F0', 4F0' and 5F0' of the shifted frequency F0' when the fundamental frequency F0 of the oscillation signal MSC of FIG. 4 is shifted to the shifted frequency F0'.

Referring to FIG. 6, the oscillation fundamental frequency F0 of the oscillation signal MSC may be shifted to the shifted frequency F0' to prevent the interference. Herein, the harmonic components 2F0, 3F0, 4F0 and 5F0 of the oscillation fundamental frequency F0 may be respectively shifted to 2F0', 3F0', 4F0' and 5F0'. In FIG. 6, 5F0', which is one of the harmonic components of the shifted frequency F0' of the oscillation signal MSC, may not overlap the second communication band CB2 unlike FIG. 5.

In the present disclosure, the oscillator may maintain a frequency of one horizontal period to be constant even when the oscillation fundamental frequency F0 is shifted. The frequency of the one horizontal period may be determined by a driving frequency of the display panel 100 and a vertical resolution of the display panel 100. For example, when the driving frequency of the display panel 100 is 60 Hz and the vertical resolution of the display panel 100 is 2500, the frequency of one horizontal period may be determined to 150 kHz.

When the oscillation fundamental frequency is f0 and a fundamental constant is N0, the frequency of one horizontal period may be f0/N0. The fundamental constant N0 may be determined such that a desired frequency of one horizontal period is obtained by dividing the oscillation fundamental frequency f0 by the fundamental constant N0. For example, when the oscillation fundamental frequency is 150 MHz, the fundamental constant N0 may be determined to 1000 so that the frequency of one horizontal period may be determined to 150 kHz.

When a first oscillation shifted frequency which is shifted from the oscillation fundamental frequency f0 by Δf is f1 and a first shift constant is N1, f1/N1 may be substantially equal to f0/N0.

Herein, following equations may be satisfied. That is, f1=f0+Δf, N1=N0+ΔN, $$\Delta f = \Delta N \frac{f0}{N0} \text{ and } \frac{f1}{N1} = \frac{f0 + \frac{f0}{N0}\Delta N}{N0 + \Delta N} = \frac{f0}{N0}.$$

Herein, ΔN may mean a first number of a unit of the frequency of one horizontal period which is shifted from the oscillation fundamental frequency f0.

As described above, when the oscillation fundamental frequency f0 is shifted to the first oscillation shifted frequency f1, a frequency shift amount Δf is set to be an integer multiple ΔN of f0/N0. When the frequency shift amount Δf is set to be the integer multiple ΔN of f0/N0, f1/N1 may remain substantially equal to f0/N0 according to the above equations so that the frequency of one horizontal period may not be changed in spite of the shift of the oscillation fundamental frequency f0. Thus, the deterioration of the display quality due to the change of the frequency of one horizontal period may be prevented.

A case where the first oscillation shifted frequency f1 is further shifted to a second oscillation shifted frequency f2 may be substantially the same as described above.

When a second oscillation shifted frequency which is shifted from the first oscillation shifted frequency f1 by Δf' is f2 and a second shift constant is N2, f2/N2 may be substantially equal to f1/N1 and f0/N0.

Herein, following equations may be satisfied. That is, f2=f1+Δf', N2=N1+ΔN', and $$\frac{f2}{N2} = \frac{f1 + \frac{f1}{N1}\Delta N'}{N1 + \Delta N'} = \frac{f1}{N1} = \frac{f0}{N0}.$$

Herein, ΔN' may mean a second number of the unit of the frequency of one horizontal period which is shifted from the first oscillation shifted frequency f1.

As described above, when the first oscillation shifted frequency f1 is shifted to the second oscillation shifted frequency f2, a frequency shift amount Δf' is set to be an integer multiple ΔN' of f1/N1. When the frequency shift amount Δf' is set to be the integer multiple ΔN' of f1/N1, f2/N2 may remain substantially equal to f1/N1 and f0/N0 according to the above equations so that the frequency of one horizontal period may not be changed in spite of the shift of the first oscillation shifted frequency f1. Thus, the deterioration of the display quality due to the change of the frequency of one horizontal period may be prevented.

In operation, the method of driving the display apparatus includes the following steps. A first step is generating a frequency of one horizontal period using an oscillation fundamental frequency and a fundamental constant. A second step is generating an oscillation signal by maintaining the frequency of one horizontal period to be constant when an oscillation fundamental frequency is shifted. A third step is generating a gate driving signal and a data driving signal based on the oscillation signal. A fourth step is outputting a gate signal to a display panel based on the gate driving signal and outputting a data voltage to the display panel based on the data driving signal.

Figure 7A:
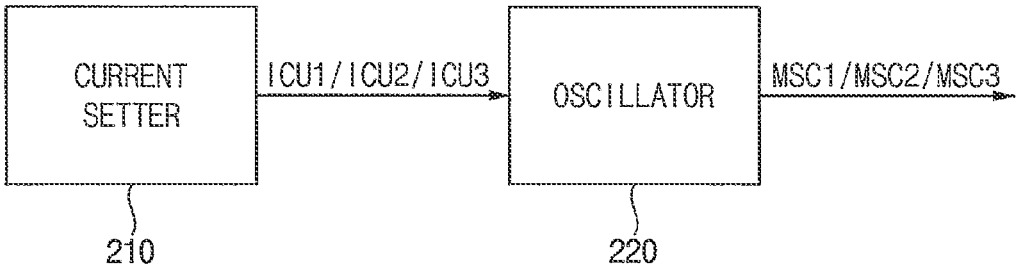
FIG. 7A is a block diagram illustrating the driving controller of FIG. 1 according to an embodiment of the present disclosure.
Figure 7B:
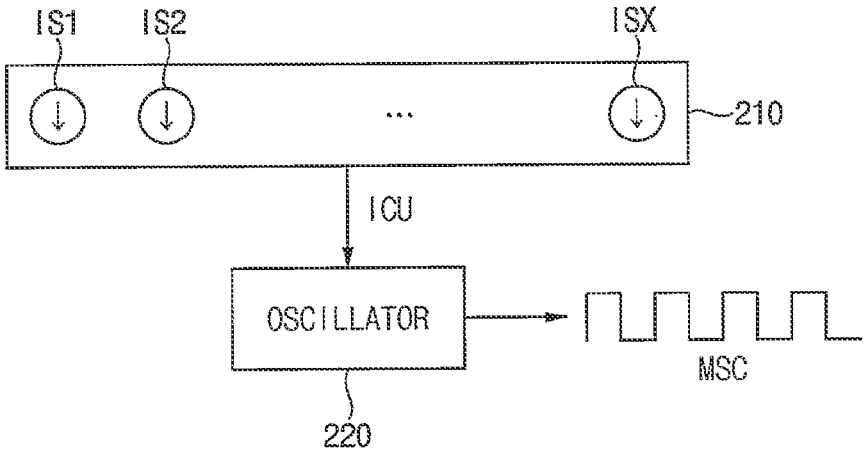
FIG. 7B is a block diagram illustrating the driving controller of FIG. 1 according to an embodiment of the present disclosure.
Figure 8:
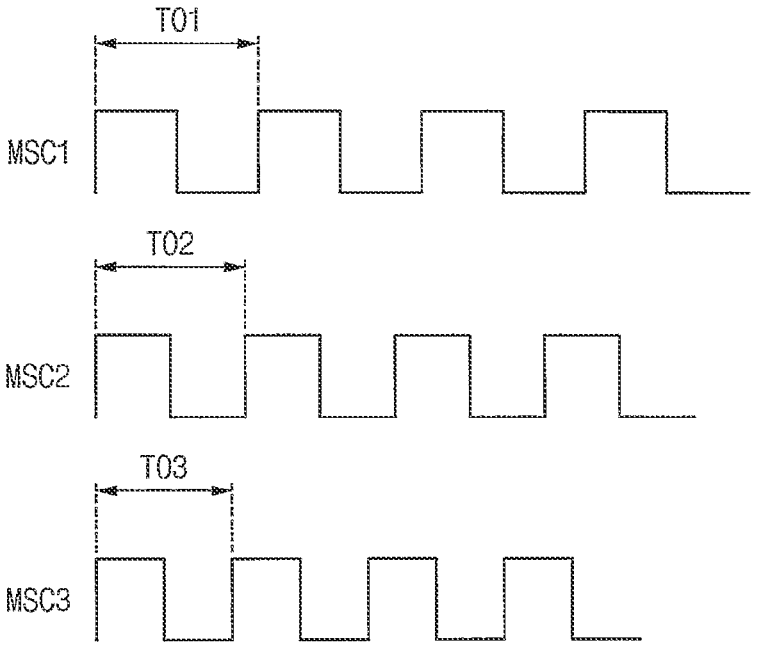
FIG. 8 is a timing diagram illustrating a waveform of an oscillation signal outputted from an oscillator of FIG. 7A.

FIG. 7A is a block diagram illustrating the driving controller 200 of FIG. 1 according to an embodiment of the present disclosure. FIG. 7B is a block diagram illustrating the driving controller 200 of FIG. 1 according to an embodiment of the present disclosure. FIG. 8 is a timing diagram illustrating a waveform of an oscillation signal MSC1, MSC2 and MSC3 outputted from an oscillator 220 of FIG. 7A.

FIG. 7A represents an example of shifting a frequency of the oscillation signal by setting an input current of the oscillator 220 of the driving controller 200 of FIG. 1.

For example, the driving controller 200 may further include a current setter 210 which is connected to the oscillator 220 to provide the input current to the oscillator 220.

The current setter 210 may output a first input current ICU1, which causes the oscillator 220 to output a first oscillation signal MSC1 having the oscillation fundamental frequency f0, to the oscillator 220. As shown in FIG. 8, a cycle of the first oscillation signal MSC1 may be T01.

The current setter 210 may output a second input current ICU2, which causes the oscillator 220 to output a second oscillation signal MSC2 having the first oscillation shifted frequency f1, to the oscillator 220. As shown in FIG. 8, a cycle of the second oscillation signal MSC2 may be T02. T02 may be shorter than T01.

The current setter 210 may output a third input current ICU3, which causes the oscillator 220 to output a third oscillation signal MSC3 having the second oscillation shifted frequency f2, to the oscillator 220. As shown in FIG. 8, a cycle of the third oscillation signal MSC3 may be T03. T03 may be shorter than T02 and T01 respectively.

The first input current ICU1, the second input current ICU2, and the third input current ICU3 may be preset by a register setting.

As shown in FIG. 7B, the current setter 210 may include a plurality of current sources IS1, IS2, . . . , ISX to set various levels of the input current ICU. The oscillator 220 may generate the oscillation signal MSC having various frequencies varied according to a change of the level of the input current ICU.

In the present embodiment, the frequency of the oscillation signal MSC may be automatically changed. For example, the frequency of the oscillation signal MSC may be sequentially varied among a plurality of predetermined frequencies. When the predetermined frequencies are f0, f1 and f2, the frequency of the oscillation signal MSC may be set to be automatically changed in an order of f0, f1, f2, f0, f1 and f2. Alternatively, when the predetermined frequencies are f0, f1 and f2, the frequency of the oscillation signal MSC may be set to be automatically changed in an order of f0, f1, f2, f1, f0, f1 and f2.

Alternatively, the frequency of the oscillation signal MSC may be randomly varied among a plurality of predetermined frequencies.

For example, the frequency of the oscillation signal MSC may be automatically changed sequentially or randomly according to an automatic change setting signal of an external host.

Figure 9:
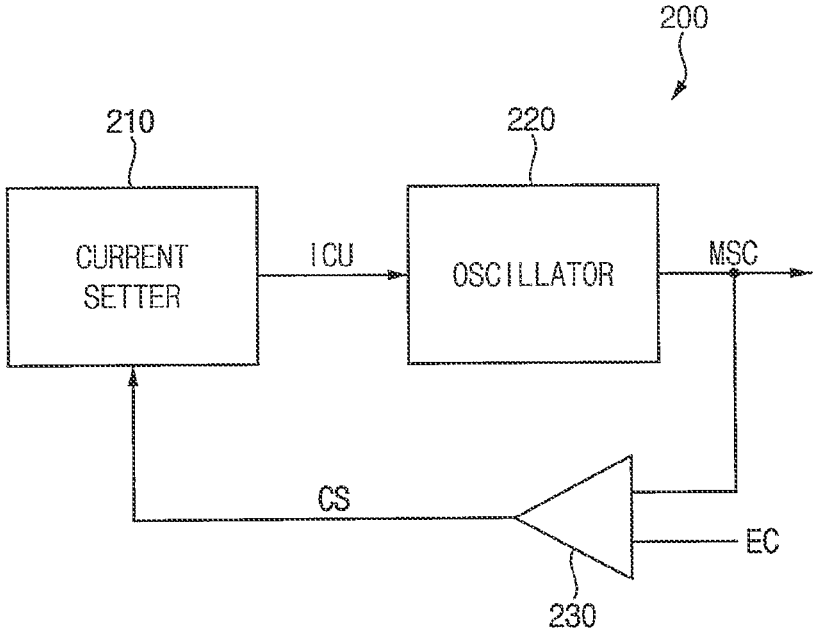
FIG. 9 is a block diagram illustrating the driving controller of FIG. 1 according to an embodiment of the present disclosure.

FIG. 9 is a block diagram illustrating the driving controller 200 of FIG. 1 according to an embodiment of the present disclosure.

FIG. 9 represents an embodiment in which an input current of an oscillator 220 of the driving controller 200 of FIG. 1 is set by comparing a feedback signal of the oscillation signal MSC to an external clock signal EC.

For example, the driving controller 200 of FIG. 9 may further include a current setter 210 providing the input current to the oscillator 220.

The driving controller 200 of FIG. 9 may further include a comparator 230 receiving the feedback signal of the oscillation signal MSC outputted from the oscillator 220 and generating a comparison signal CS to control the current setter 210.

For example, the comparator 230 may include a first input terminal receiving the oscillation signal MSC, a second input terminal receiving the external clock signal EC and an output terminal outputting the comparison signal CS representing a result of comparison between the signal of the first input terminal and the signal of the second input terminal.

Herein, the external clock signal EC may be a clock signal of a communication interface (e.g. MIPI) for communication between the driving controller 200 and the external host. For example, the frequency of the external clock signal EC may be greater than the oscillation fundamental frame.

According to the present embodiment, the frequency of the one horizontal period may be kept constant even when the oscillation fundamental frequency of the oscillation signal MSC is shifted. When the oscillation fundamental frequency or the harmonic components of the oscillation fundamental frequency overlap the communication band, the oscillation fundamental frequency may be shifted such that the oscillation fundamental frequency or the harmonic components of the oscillation fundamental frequency do not overlap the communication band. Thus, the EMI of the display apparatus may be reduced.

In addition, in spite of the shift of the oscillation fundamental frequency, the frequency of the one horizontal period may not be changed so that the display quality may not be deteriorated due to the shift of the oscillation fundamental frequency.

According to the driving controller, the display apparatus and the method of driving the display apparatus of the present disclosure as explained above, the EMI may be reduced so that the display quality of the display panel may not be deteriorated.

The foregoing is illustrative of the present disclosure and is not to be construed as limiting thereof. Although a few embodiments of the present disclosure have been described, those skilled in the art will readily appreciate that many modifications are possible in the embodiments without materially departing from the novel teachings and advantages of the present disclosure. Accordingly, all such modifications are intended to be included within the scope of the present disclosure as defined in the claims. In the claims, means-plus-function clauses are intended to cover the structures described herein as performing the recited function and not only structural equivalents but also equivalent structures. Therefore, it is to be understood that the foregoing is illustrative of the present disclosure and is not to be construed as limited to the specific embodiments disclosed, and that modifications to the disclosed embodiments, as well as other embodiments, are intended to be included within the scope of the appended claims. The present disclosure is defined by the following claims, with equivalents of the claims to be included therein.

What is claimed is:

1. A driving controller comprising:

an oscillator configured to generate an oscillation signal based on an input current; and a signal generator configured to generate a gate driving signal and a data driving signal based on the oscillation signal, wherein the oscillator is configured to maintain a frequency of one horizontal period of the oscillation signal to be constant when an oscillation fundamental frequency is shifted.

2. The driving controller of claim 1, wherein, when the oscillation fundamental frequency is f0, and a fundamental constant is N0, the frequency of one horizontal period is f0/N0.

3. The driving controller of claim 2, wherein, when a first oscillation shifted frequency which is shifted from the oscillation fundamental frequency by Δf is f1 and a first shift constant is N1, f1/N1 is substantially equal to f0/N0.

4. The driving controller of claim 3, wherein f1=f0+Δf, N1=N0+ΔN, $$\Delta f = \Delta N \frac{f0}{N0} \text{ and } \frac{f1}{N1} = \frac{f0 + \frac{f0}{N0}\Delta N}{N0 + \Delta N} = \frac{f0}{N0},$$

where ΔN means a first number of a unit of the frequency of one horizontal period which is shifted from the oscillation fundamental frequency.

5. The driving controller of claim 4, wherein when a second oscillation shifted frequency which is shifted from the first oscillation shifted frequency by Δf' is f2 and a second shift constant is N2, f2/N2 is substantially equal to f1/N1 and f0/N0.

6. The driving controller of claim 5, wherein f2=f1+Δf', N2=N1+ΔN', $$\Delta f' + \Delta N' \frac{f1}{N1} \text{ and } \frac{f2}{N2} = \frac{f1 + \frac{f1}{N1}\Delta N'}{N1 + N'} = \frac{f1}{N1} = \frac{f0}{N0},$$

where ΔN' means a second number of the unit of the frequency of one horizontal period which is shifted from the first oscillation shifted frequency.

7. The driving controller of claim 3, further comprising a current setter configured to provide the input current to the oscillator, wherein the current setter is configured to output a first input current, which causes the oscillator to output a first oscillation signal having the oscillation fundamental frequency, to the oscillator, and wherein the current setter is configured to output a second input current, which causes the oscillator to output a second oscillation signal having the first oscillation shifted frequency, to the oscillator.

8. The driving controller of claim 7, further comprising a comparator configured to receive the oscillation signal outputted from the oscillator and to generate a comparison signal configured to control the current setter.

9. The driving controller of claim 8, wherein the comparator comprises a first input terminal configured to receive the oscillation signal, a second input terminal configured to receive an external clock signal, and an output terminal configured to output the comparison signal representing a result of comparison between the first input terminal and the second input terminal.

10. The driving controller of claim 9, wherein the external clock signal is a clock signal of a communication interface for communication between the driving controller and an external host.

11. The driving controller of claim 10, wherein a frequency of the external clock signal is greater than the oscillation fundamental frequency.

12. A display apparatus comprising:

a display panel;

a gate driver configured to output a gate signal to a gate line of the display panel;

a data driver configured to output a data voltage to a data line of the display panel; and a driving controller configured to control the gate driver and the data driver, wherein the driving controller includes:

an oscillator configured to generate an oscillation signal based on an input current; and a signal generator configured to generate a gate driving signal and a data driving signal based on the oscillation signal, wherein the oscillator is configured to maintain a frequency of one horizontal period of the oscillation signal to be constant when an oscillation fundamental frequency is shifted.

13. The display apparatus of claim 12, wherein a frequency of the gate driving signal is synchronized with a frequency of the oscillation signal, and a frequency of the gate signal is synchronized with the frequency of the oscillation signal.

14. The display apparatus of claim 12, wherein a frequency of the data driving signal is synchronized with a frequency of the oscillation signal.

15. The display apparatus of claim 12, wherein when the oscillation fundamental frequency is f0 and a fundamental constant is N0, the frequency of one horizontal period is f0/N0.

16. The display apparatus of claim 15, wherein when a first oscillation shifted frequency which is shifted from the oscillation fundamental frequency by Δf is f1 and a first shift constant is N1, f1/N1 is substantially equal to f0/N0.

17. The display apparatus of claim 16, wherein f1=f0+Δf, N1=N0+ΔN, $$\Delta f = \Delta N \frac{f0}{N0} \text{ and } \frac{f1}{N1} = \frac{f0 + \frac{f0}{N0}\Delta N}{N0 + \Delta N} = \frac{f0}{N0},$$

where ΔN means a first number of a unit of the frequency of one horizontal period which is shifted from the oscillation fundamental frequency.

18. The display apparatus of claim 17, wherein when a second oscillation shifted frequency which is shifted from the first oscillation shifted frequency by Δf' is f2 and a second shift constant is N2, f2/N2 is substantially equal to f1/N1 and f0/N0.

19. A method of driving a display apparatus, the method comprising steps of:

generating a frequency of one horizontal period using an oscillation fundamental frequency and a fundamental constant;

generating an oscillation signal by maintaining the frequency of one horizontal period to be constant when an oscillation fundamental frequency is shifted;

generating a gate driving signal and a data driving signal based on the oscillation signal;

outputting a gate signal to a display panel based on the gate driving signal; and outputting a data voltage to the display panel based on the data driving signal.

20. The method of claim 19, wherein, when the oscillation fundamental frequency is f0 and the fundamental constant is N0, the frequency of one horizontal period is f0/N0.

* * * * *